United States Patent [19]

Roberts

[11] 4,135,748

[45] Jan. 23, 1979

[54] PORTABLE DOOR LOCK

[76] Inventor: Charles K. Roberts, 517 S. Ridgewood Ave., Daytona Beach, Fla. 32014

[21] Appl. No.: 808,706

[22] Filed: Jun. 21, 1977

[51] Int. Cl.[2] ..... E05C 17/54

[52] U.S. Cl. ..... 292/298

[58] Field of Search ..... 292/289-298, 292/254

[56] References Cited

U.S. PATENT DOCUMENTS

| | | | |
|---|---|---|---|
| 1,167,342 | 1/1916 | Fraser | 292/289 |
| 3,313,566 | 4/1967 | Sipes | 292/292 |

FOREIGN PATENT DOCUMENTS

| | | | |
|---|---|---|---|
| 26604 of | 1909 | United Kingdom | 292/264 |

*Primary Examiner*—Richard E. Moore

*Attorney, Agent, or Firm*—Walter G. Finch

[57] ABSTRACT

This invention is an improved security door lock, particularly to night security latching arrangements, and specifically to a portable door lock that can be carried during travel for use in securing hotel and motel doors against entry. The portable door lock of this invention can also be used in the home or permanent residence for security against the entry of unauthorized persons. The convenient small size and configuration of this device makes it possible to carry it in the pocket, on a key-chain, or in a suitcase compartment while travelling.

6 Claims, 4 Drawing Figures

PORTABLE DOOR LOCK

BACKGROUND AND SUMMARY OF THE INVENTION

This invention relates generally to door locks, particularly to night security latching arrangements for doors. The invention specifically relates to a night security latching arrangement that is portable and can be carried easily during travel. This does not preclude the use of the device during daytime needs to secure a door against entry, and the use of the device in the home as well as during travel. It should be understood that the use during night or day, use in the home, and use during travel are all within the scope and intent of this invention.

For a long time there has been a need for a very simple, inexpensive, convenient, and easily applied locking device for securing doors. This invention answers that need and goes further, it is portable so that it can be carried easily during travel. It can be carried in the pocket, on a key-chain, or in a small compartment in a suitcase.

Dead bolt type security locks are the major deterrent to burglary by entry through doors. Doors without such securit-type devices, having only the usual type lock, are easily entered by experienced thieves. Such locks are "picked" by thieves using a variety of devices. In the case of hotels and motels, master keys, lost keys, and stolen keys offer easy access to breaking and entering by criminals. The present invention prevents this.

In addition to the "picking" of the lock or the use of unauthorized keys, various uses of flexible knives, plastics cards, and the like have been used to "slip" the latch open. This invention eliminates those possibilities.

Many homes, apartments, hotels, and motels do not have the hereinbefore mentioned dead bolt type locks (in addition to the regular door latching arrangement at the knob). Thus, illegal entry is much more convenient and easier for the criminal. Even the dead bolt type lock can be opened with master keys, lost keys, stolen keys, and by other such means. With the present invention security against illegal entry is assured.

The present invention gives privacy and protection to the user while in the home or while in the bedroom during travel. The device may be used on doors even though the usual knob latching arrangement or dead bolt type locks are in use.

The device of this invention is used in combination with strike plate and keeper pocket or recess in the door jamb and the neck at the base of the door knob on the inside of the door. No permanent or damaging fastening is made to the door or door jamb. The device is a simple portable attachment, one end of which the user places into the keeper pocket or recess, closes the door, and loops the other end around the neck of the doorknob or the inside of the door, thus acting as a connecting unit. It can be installed with the door closed.

The device of this invention can be used on left or right hand opening doors. For doors opening in either direction (in or out), the end can be made into a "T" shape, instead of hook. The "T" shape is not shown on the drawing, but operates the same as the hook-type for application, and is within the scope and intent of this invention.

Accordingly, it is an object of this invention to provide a portable lock device for securing doors against illegal entry.

It is another object of this invention to provide a portable lock device that can be used on doors that open to the left or to the right.

It is a further object of this invention to provide a portable lock device that can be used on doors that open inwardly or open outwardly.

It is still another object of this invention to provide a portable lock device that is simple, small, economical, and convenient to carry on the person or with the person when travelling.

It is yet another object of this invention to provide a portable lock device that can be used in the home as well as during travel.

It is also an object of this invention to provide a portable lock device that can be used on doors that have other permanently installed locking devices.

Further objects and advantages of the invention will become more apparatent in light of the following description of the preferred embodiments.

DESCRIPTION OF THE PREFERRED EMBODIMENTS

Figure 1:
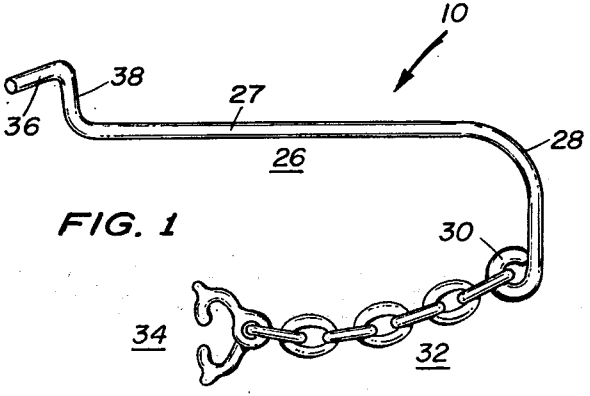
FIG. 1 is a complete portable door lock assembly.

Turning now to the drawings and particularly to FIG. 1, the complete portable door lock is shown at 10. The portable door lock 10 comprises two major parts, a rod-like latching bar 26 and a chain assembly 32.

The chain assembly 32 has a catch assembly 34 at the free end, and at the other end the end of the chain assembly 32 is attached to the latching bar 26 by a loop or eye 30 that is formed at the end of the latching bar 26.

Figure 4:
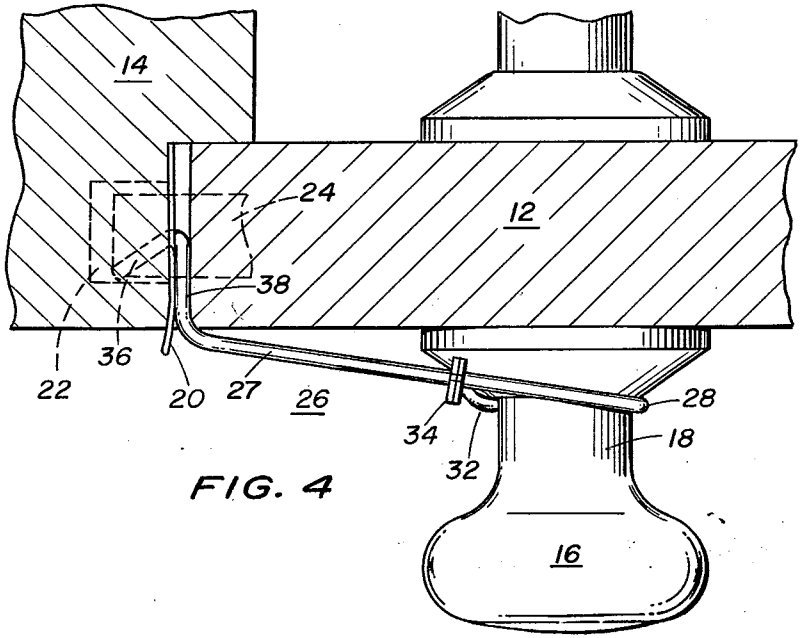
FIG. 4 is a cross sectional view 4—4 of FIG. 3.

The latching bar 26 is formed into a configuration as shown in FIG. 1. As noted previously, at one end is a formed loop or eye 30 to attach the chain assembly 32 to the latching bar 26. The bar is then bent in a radius 28 that approximates a fit for the average neck 18 of a door knob 16 as shown in FIG. 4.

The operation and use of the portable door lock 10 will be explained later hereinafter, at which time the aforementioned parts of the chain assembly 32 and the latching bar 26 and other parts of the latching bar 26 are hereinafter described.

The aforementioned radial bend 28 lies in the same plane as the plane of the loop or eye 30. After the radial bend 28 the latching bar 26 continues as a straight shank 27. At the distal end of the shank 27 from the radial bend 28, the straight shank 27 is bent at 90° in a plane perpendicular to the aforementioned plane of the eye 30 and the radial bend 28 to form a short straight section 38. Thereafter, the end of latching bar 26 is bent at an angle greater than 90°, but less than 135° to form a hook 36. The plane of the 90° bend of the shank 27 to form the short straight section 38 in preparation for the hook bend 36, and the plane of the hook 36 are identical planes.

In making the 90° bend for the short straight section 38, the length of the short straight section 38 is such that it clears the inside surface of the door when the hook 36 is in place in the keeper pocket or recess. This can be seen clearly in FIG. 4 wherein the hook 36 is shown in the keeper pocket or recess 22 and the short straight section 38 can be seen clearing the inside face of the door 12 as it bends into the straight shank 27 of the latching bar 26.

In FIG. 4 it can be seen how the straight shank 27 continues toward the door knob 16 and the aforementioned radial bend 28 curves around the neck 18 of the door knob 16. It should be noted that the flexibility of the rod of the long straight shank 27 permits the latching bar 26 to flex and bend outward at the 90° radius bend between the short straight section 38 and the straight shank 27 as the portable door lock 10 is put in place on door 12.

Figure 2:
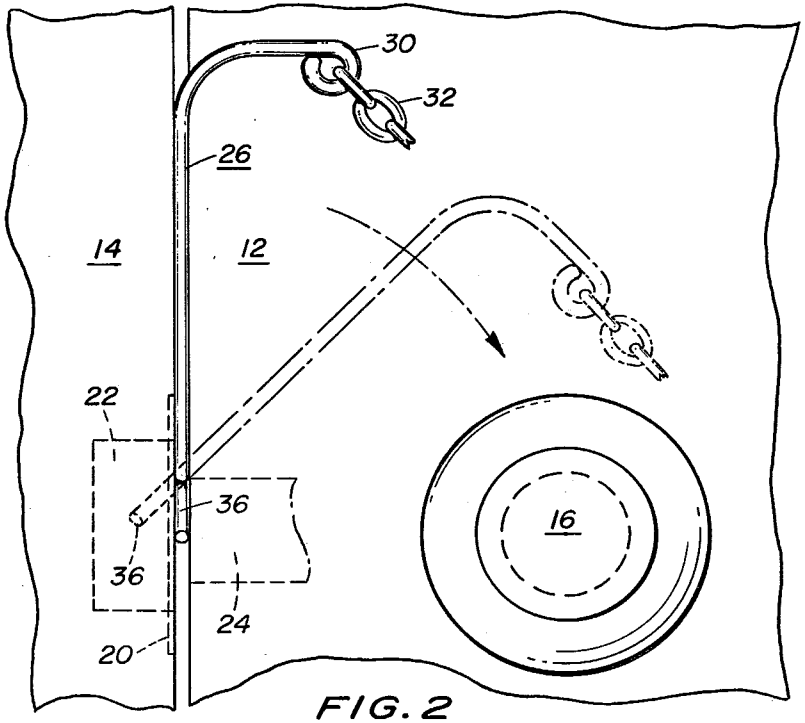
FIG. 2 is a partial view of a typical door with the portable door lock being inserted.

To install the portable door lock 10, refer to FIG. 2. First, as the door is closed the hook 36 and the short straight section 38, being in the same plane as each other and also being in a plane with the 90° bend leading to the straight shank 27 as well as the straight shank 27 being in that same plane, the said hook 36 and the short straight section 38 are inserted between the door 12 and the door jamb 14 at the keeper strike plate 20. This is clearly shown in FIG. 2 wherein the latching bar 26 is shown in solid lines and the hook end 36 can be seen at the bottom or distal end of the latching bar 26.

Continuing now the installation of the portable door lock 10, as shown in FIG. 2, the keeper 24 of the permanently installed door lock system is held in the withdrawn position by turning the knob 16 to withdraw the keeper 24 and hold the keeper 24 in the withdrawn position. As this is done the aforementioned parts of the latching bar 26 are inserted between the door 12 and the door jamb 14 at the keeper plate 20 as previously described. The latching bar 26 is then turned in an arc toward the door knob 16 as shown by dashed lines for the latching bar 26 and the directional arrow.

As the latching bar 26 is turned toward the door knob 16 the hook end 36 swings into the empty keeper pocket or recess 22 as shown by the dotted lines in FIG. 2.

Figure 3:
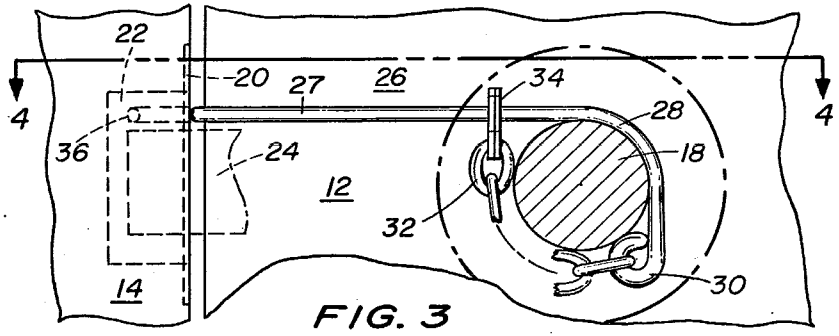
FIG. 3 is a partial view of a typical door with the portable door lock secured into position.

When the latching bar 26 is down to the door knob 16 and the radial bend 28 is around the neck 18 of the door knob 16, as shown in FIG. 3, the door knob 16 is released so that the keeper 24 can move forward into its "keeper" position inside the keeper pocket or recess 22.

As can be seen in FIG. 3, the hook end 36 is now in a horizontal position inside of the keeper pocket or recess 22 and clear of the keeper 24. The portable door lock 10 is seen in its securing position in FIG. 3 with the radial bend 28 around the neck 18 of the door knob 16, and the chain assembly 32 completing the securing position by its attachment to the loop or eye 30 of the latching bar 26 and then having the catch assembly 34, at the end of the chain assembly 32, secured around the straight shank 27 of the latching bar 26.

The final securing position can also be seen in FIG. 4 with the catch assembly 34 secured around the straight shank 27.

With the portable door lock 10 in this securing position, the door cannot be opened, even when the keeper 24 is withdrawn from the keeper pocket or recess 22 and thus criminal entry is prevented.

To release the portable door lock 10 from its securing position on door 12, the catch assembly 34 is removed from the straight shank 27, the keeper 25 is then withdrawn from the keeper pocket or recess 22 by turning the knob 16, thereafter, the latching bar 26 is lifted through the radius in reverse, as previously indicated on FIG. 2, until the hook end 36 is withdrawn from the keeper pocket or recess 22. When the hook end 36 is returned to the position between the door jamb 14 and the door 12 at the keeper striker plate 20, the door can be pulled open as the latching bar 26 of the portable door lock 10 comes out free at the same time. The latching bar 26 can also be removed without opening the door 12.

It should be noted that the aforementioned installation of the device was described by inserting the portable door lock 10 as the door was opened, it can also be installed with the door closed. With the door closed, and the door knob 16 turned so as to withdraw the keeper 24 from the keeper pocket or recess 22, the aforementioned hook 36 and the short straight section 38, being in the same plane as each other and also being in a plane with the 90° bend leading to the straight shank 27, as well as the straight shank 27 being in the same plane, said hook 36 and said straight section 38 are inserted between the closed door 12 and the door jamb 14 at the keeper strike plate 20. This can be seen clearly in FIG. 2 wherein the latching bar 26 can be seen in solid lines with the straight shank 27 standing vertically at the space between the closed soor 12 and the door jamb 14. Thereafter the latching bar 26 is then turned in an arc as previously described for the installation as the door is being closed.

As disclosed previously hereinbefore, for doors that open outwardly the hook end 36 is in the form of "T" (not shown) so as to secure it against movement of the door outwardly.

It is to be understood that various uses of the terms "spring latch" and "dead bolt" and other associated words in place of words used herein, such as "keeper", "keeper pocket" or "recess" are merely variations of term usage and are to be considered as within the same meaning and intent as the terms and words used herein.

It is to be understood that variations in the configuration of the latching bar 26, the chain assembly 36 configuration, the cross sectional shape of the material in the latching bar 26, a variation of materials, and other such modifications are within the scope and intent of this invention.

Accordingly, modifications and variations to which the invention is susceptible may be practiced without departing from the scope of the appended claims.

What is claimed is:

1. A method for latching a closed door having an inside knob on said closed door and a keeper recess in the jamb, comprising, inserting a connecting unit in said keeper recess in said jamb while the door is closed, and attaching said connecting unit to said inside knob of said closed door.

2. A closed door portable lock system for attachment to a door system that is closed, said door system consisting of a framework having a keeper pocket therein and having a closed door mounted within said framework, said closed door having a door knob as part thereof, said door lock system consisting of:

a latching means coupling said keeper pocket to said door knob, with the connection of said keeper pocket to said door knob being made by placing said latching means between said closed door and said framework to reach said keeper pocket while said door is in closed postion; and securing means attached to said latching means to further secure said latching means to said door knob.

3. The door lock system as recited in claim 2, wherein said latching means is formed from a single rod-like member.

4. The door lock system as recited in claim 2, wherein said securing means consists of a chain-like member attached to said latching means and a catch member attached to said chain-like member at the end opposite to that end attached to said latching means.

5. The door lock system as recited in claim 3, wherein said single rod-like member is formed into a configuration consisting of:

an eye to which said securing means is attached;

a first 90° radial bend adjacent to and a continuation of said eye structure and in same plane with said eye, and wherein said 90° radial bend approximates radius of the neck of a door knob;

a straight shank extending from and as a continuation of said radial bend;

a second 90° radial bend extending from and as a continuation of said straight shank, said radial bend being in a plane perpendicualr to said plane of said eye and said first 90° radial bend;

a short straight section extending from and as a continuation of said second 90° radial bend; and a hook-like bend extending from and as a continuation of said short straight section, said hook-like bend extending from and as a continuation of said short straight section, said hook-like bend and said short straight section being in same plane with said second 90° radial bend.

6. The door lock system as recited in claim 5 and additionally, an extension on said hook-like bend at juncture of said hook-like bend with said short straight section to convert it to a "T" shaped member.

* * * * *